US005937723A

United States Patent [19]

Kirikoshi et al.

[11] Patent Number: 5,937,723

[45] Date of Patent: Aug. 17, 1999

[54] MECHANISM FOR CUTTING A SHEET

[75] Inventors: Takeharu Kirikoshi, Tokyo; Takahisa Kinoshita, Kanagawa, both of Japan

[73] Assignee: NEC Corporation, Tokyo, Japan

[21] Appl. No.: 08/867,525

[22] Filed: Jun. 2, 1997

[30] Foreign Application Priority Data

May 31, 1996 [JP] Japan ..... 8-138774

[51] Int. Cl.[6] ..... B26D 5/08

[52] U.S. Cl. ..... 83/614; 83/659; 83/578; 83/481; 83/483; 83/488; 83/509

[58] Field of Search ..... 83/614, 578, 633, 83/676, 679, 659, 481, 501, 497, 493, 496, 483, 485, 488, 500, 509, 495; 30/240, 265, 205, 241, 263, 276

[56] References Cited

U.S. PATENT DOCUMENTS

| | | | |
|---|---|---|---|
| 493,351 | 3/1893 | Burbank | 83/501 X |
| 1,609,619 | 12/1926 | Galvin | 30/265 |
| 2,861,340 | 11/1958 | Hazzard | 30/240 |
| 3,186,282 | 6/1965 | Waterhouse | 83/500 X |
| 3,682,032 | 8/1972 | Pfeiffer | 83/501 X |
| 3,791,246 | 2/1974 | Lazickas | 83/495 X |
| 4,548,117 | 10/1985 | Frye | 83/676 X |
| 4,574,480 | 3/1986 | Dunn | 30/240 X |
| 4,638,702 | 1/1987 | DeBin et al. | 83/659 X |
| 4,854,204 | 8/1989 | Faltin | 83/500 X |
| 5,251,378 | 10/1993 | Ayer et al. | 30/205 X |
| 5,307,716 | 5/1994 | Onishi et al. | 83/614 X |
| 5,325,753 | 7/1994 | Schussler | 83/676 X |
| 5,503,053 | 4/1996 | Onishi et al. | 83/614 X |
| 5,613,415 | 3/1997 | Sanpei | 83/485 |

FOREIGN PATENT DOCUMENTS

| | | | |
|---|---|---|---|
| 2151621 | 4/1973 | Germany | 83/496 |
| 42 03 139 A1 | 8/1993 | Germany | 83/663 |
| 50-24466 | 8/1975 | Japan . | |
| 4-152096 | 5/1992 | Japan | 83/663 |
| 6-134692 | 5/1994 | Japan . | |
| 6-190775 | 7/1994 | Japan | 83/663 |
| 7-24782 | 1/1995 | Japan . | |
| 7-100791 | 4/1995 | Japan . | |
| 7-124892 | 5/1995 | Japan . | |

*Primary Examiner*—M. Rachuba

*Attorney, Agent, or Firm*—Sughrue, Mion, Zinn, Macpeak & Seas, PLLC

[57] ABSTRACT

A mechanism for cutting a sheet of paper includes a rotary blade and a counter blade. The periphery of the counter blade is substantially flush with a paper-setting surface on one side of a stand portion of a cutter frame. The axis of the counter blade is disposed forwardly of the axis of the rotary blade. The rotary blade and counter blade are stored in a blade stand. The cutter frame supports the blade stand for forward movement and the subsequent rearward movement. The cutter frame is provided with a driver including pulleys and a wire. The driver moves the blade stand along the stand portion of the frame.

20 Claims, 15 Drawing Sheets

MECHANISM FOR CUTTING A SHEET

BACKGROUND OF THE INVENTION

1. Field of the Invention

The present invention relates to a mechanism for cutting a sheet of paper that is discharged from a roll incorporated in a facsimile or copying or printing machine into a desired size. More particularly, the present invention relates to a sheet cutting mechanism of the type that moving a blade holding carriage along a straight rail extending across a sheet causes the blade to cut the sheet into a desired length or size.

2. Description of the Related Art

JP-A 6-134692 discloses a sheet cutting mechanism that includes an elongate straight blade, which is hereinafter called as a stationary blade, and a displaceable blade. In the known mechanism, cutting a sheet of paper is conducted by, with the displaceable blade held against the stationary blade, moving the displaceable blade along the stationary blade. This is further described in connection with FIG. 14.

Referring to FIG. 14, the stationary blade is designated by the reference numeral 20. The stationary blade 20 is fixedly attached to a cutter frame 21 on a downwardly facing surface such that the stationary blade 20 extends in the longitudinal direction of the frame 21. The frame 21 is bent, at its one edge portion, upwardly to define a guide 22 for motion of a carriage. The stationary blade 20 extends along the guide 22.

The carriage 23 includes a holder 24 that is recessed to receive the guide 22. An arm for unitary motion interconnects the carriage 23 and a rotary blade support 25. Thus, the rotary blade support 25 is permitted for reciprocal motion along the guide 22 in the longitudinal direction of the stationary blade 20. Two pulleys are arranged at portions adjacent the remotest, in the longitudinal direction, ends of the stationary blade 20. One pulley out of them, which is disposed on this side viewing in FIG. 14, is mounted to receive torque from a motor via a drive shaft, a pinion on the drive shaft and an appropriate gearing. A wire is wound around both of the pulleys and tensioned between the pulleys by, for example, a coil spring. The wire engages, at its appropriate portion, the carriage 23. Torque of the motor is transmitted through the pinion, gearing, pulley and wire to the carriage 23, urging the carriage 23 for reciprocal motion along the guide 22. At its outer periphery, the carriage 23 has a leading paper guide portion 27 and an escape groove 28. As the carriage 23 advances along the guide 22, the paper guide portion 27 guides paper toward a contact point between the stationary and rotary blades 20 and 26 (this contact point being hereinafter called as a cutting point). During the movement of the carriage 23, the escape groove 28 permits evacuation of the portion of paper, which has been cut.

The arm interconnects the carriage 23 and the rotary blade support 25 for unitary motion. The rotary blade 26 and stationary blade 20 overlap each other at their edge portions. The rotary blade 26 is urged into press-contact with the stationary blade 20. Although not illustrated in FIG. 14, the rotary blade 26 has, on its hidden surface, a pressure disc (a turning wheel) connected thereto for unitary rotation therewith. As a portion of this pressure disc is always held in contact with the stationary blade 20, movement of the carriage 23 causes the rotary blade 26 to turn and move along the edge of the stationary blade 20.

It is now described how the sheet cutting mechanism operates to cut the sheet of paper from a roll. The carriage

23 waits for a call at one position, namely standby position, which limits movement of the carriage 23 in FIG. 14. When the motor pulls the wire, the carriage 23 moves along the guide 22, causing the rotary blade 26 that is carried by the rotary blade support 25 to move along the stationary blade 20. The rotary blade 26 is held in press-contact with the stationary blade 20 during this movement. The rotary blade 26 is urged to turn during this movement owing to the pressure disc pressed against the stationary blade 20. Upon or immediately after the carriage 23 having reached the beginning end of the paper, the leading guide portion 27 on the front end of the carriage 23 starts guiding the paper toward the cutting point. The rotary blade 26 and the stationary blade 20 cooperate with each other to cut the paper at the cutting point The portion of the paper that has been cut is evacuated away from the cutting point by the escape groove 28 so as not to interfere with the cutting operation. When the carriage 23 has reached the opposite limit position after completion of cutting operation of paper, the motor is reversed, pulling, via the wire, the carriage 23 in the opposite direction, and returning the carriage 23 to the standby position. One cycle of cutting operation ends when the carriage 23 has returned to the standby position.

An improved version of the sheet cutting mechanism of the kind described above is proposed in JP-A 7-124892. FIG. 15 shows one embodiment of a sheet cutting mechanism incorporating this proposal. According to this proposed sheet cutting mechanism, a rotary blade 26 is angled with respect to a stationary blade 20 such that the edge of the rotary blade 26 engages the edge of the stationary blade 20 at a single contact point. During movement of a carriage 23 for cutting operation, the rotary blade 26 is urged to turn owing to moment occurring at the contact point.

There have been proposed sheet cutting mechanisms that do not employ a stationary blade. JP-A 7-100791 and JP-A 7-24782 disclose inventions relating to the sheet cutting mechanisms of this type.

FIG. 16 shows a fragmentary perspective view of a sheet cutting mechanism proposed by JP-A 7-100791. In this known cutting mechanism, a rotary blade 30 and an auxiliary blade 31 are mounted in a holder 32. The rotary blade 30 rotates and cooperates with the auxiliary blade 31 to cut the sheet in response to movement of the holder 32.

JP-A 7-24782 proposes transversely cutting a sheet of paper with a pair of circular blades; each carried by portions of a holder. The holder portions are interconnected by a coupling portion that is disposed in the trailing side of the circular blades with respect to movement of circular blades for cutting operation. During movement of the holder to cross the sheet of paper, the circular blades are urged to rotate to pull the paper toward a cutting point at which the circular blades engage each other.

FIG. 17 is a fragmentary perspective view of the sheet cutting mechanism disclosed in JP-A 7-24782.

Referring to FIG. 17, in this cutting mechanism, the holder 40 has pivoted thereto two circular blades 41 and 42. The circular blades 41 and 42 are disposed on one and the opposite sides of sheet of paper to be cut. The circular blade 41 is slightly angled with respect to the circular blade 42. This arrangement permits the circular blades 41 and 42 to engage each other at a single contact point to form one intersection, which contributes to cutting of paper, of two intersections of the outer peripheries of the circular blades 41 and 42. At least one of the two circular blades is urged to turn in response to movement of the holder 40. The holder 40 includes the coupling portion 44, which interconnects the holder portions, each supporting one of the circular blades 41 and 42, in order to allow a single rail to guide the holder 40. The coupling portion 44 is disposed in the trailing side of the two circular blades 41 and 42. In order to guide paper discharged by the circular blades 41 and 42 away from the coupling portion 44, the holder 40 is provided with a guide portion 43.

In the sheet cutting mechanisms, the blades move at high speeds. Thus, the performance of the cutting mechanisms depends heavily on how easily the blades can cut into the paper initially. If it is required to cut the paper easily and quickly, what one has to do is to make an initial cut into the paper from its edge and then, with the scissors held open, press the scissors in a direction you desire. This belongs to the common knowledge in every day life. If the paper to be cut is of the wet type, such as heat-sensible paper used in facsimile or printing machines, so-called "press cutting" technique is not recommendable. In this case, it is recommended to pivot the blades of the scissors to cut the paper.

The known sheet cutting mechanisms discussed above show good cutting quality, but fail to show any measure to accomplish a smooth cut-in. Further discussion is made in connection with FIGS. 12(*a*), 12(*b*) and 12(*c*). FIG. 12(*a*) shows, in arrows, a load which the paper is subject to upon making an initial cut by the known sheet cutting mechanism using the circular blade 26 in combination with the stationary blade 20. FIG. 12(*b*) shows, in arrows, a load, which the paper is subject to upon making an initial cut by the sheet cutting mechanism using the circular blade 30 in combination with the auxiliary blade 31. FIG. 12(*c*) shows, in arrow, load, which the paper is subject to upon making an initial cut by the sheet cutting mechanism using the two circular blades 41 and 42. As seen from FIGS. 12(*a*), 12(*b*) and 12(*c*), the paper is pressed owing to reaction upon making an initial cut. This hampers smooth operation to make an initial cut into the paper. This problem will be solved if the edge of paper is pressed on a stand or circular blades extremely large, in diameter, are used. However, these measures induce other problem that the setting quality of paper become worse or the number of component parts increases excessively or the cutting mechanism becomes bulky. Thus, one must expect some load to which the paper is subject to, and slanted or notched surface resulting from cutting the paper inwardly as deep as 10 mm. In high humidity, the paper of the wet type, such as thermograph paper, tends to jam. Particularly, in the sheet cutting mechanism described in JP-A 7-100791 or JP-A 7-24782, the paper cutting surface is separated from the edge of the stand, on which the paper is set, so that the paper is subject directly to the influence of the force tending to press the paper. In these cutting mechanisms, the circular blade is improved in its cutting quality and/or it is well arranged, enhancing the cutting quality of the cutting mechanism for its increased cut-in capability, thus reducing the influence of the force tending to press the paper.

There is another task to be accomplished.

In the sheet cutting mechanism using the stationary blade and the circular blade, the stationary blade is very expensive. This is because, in order to provide good cutting quality, the stationary blade must be straight and flat to a preset high degree of precision, and steel must be used as the material of the stationary blade. JP-A 7-124892 teaches the use of a product resulting from punching out a stainless steel belt as the stationary blade. However, further cost reduction cannot be expected because the material itself is expensive.

The sheet cutting mechanisms described in JP-A 7-100791 and JP-A 7-24782 do not use a stationary blade and thus they are advantageous upon reduction of cost. In the case of the sheet cutting mechanism of JP-A 7-100791, the circular blade and the auxiliary blade, which are displaceable with the carriage, engage each other at contact points that are unaltered. In other words, the auxiliary blade is subject to local stress at the contact points whenever the carriage moves, causing excessively quick deterioration of the cutting performance. JP-A 7-100791 teaches the use of a circular rotary blade as the auxiliary blade. However, there is no description as to the structure of such circular rotary blade. Thus, it appears that this teaching does not involve anything beyond what is described in JP-A 7-24782 with regard to the sheet cutting mechanism.

The sheet cutting mechanism according to JP-A 7-24782 is further described in connection with FIG. 13(*c*). FIG. 13(*c*) shows an opening angle of the sheet cutting mechanism using two circular blades. In the sheet cutting mechanism of JP-A 7-24782, the two thin disk-like circular blades engage each other at a single point. In this case, as shown in FIG. 13(*c*), the opening angle defined between the two circular blades becomes inevitably large. This state may be referred to as scissors with its blades opened widely. Thus, the cutting quality is not good. It is well known as the everyday common sense that scissors provide good cutting quality upon pressing through the paper if its blades are held opened less widely. In order to improve the cutting quality, what is needed is to increase force with which the two circular blades engage each other at a single contact point where the sharp-edged circular blades meet. In this case, it is likely that the edges are damaged. In this known mechanism, one of the two circular blades is urged to rotate and the other follows this rotation during cutting operation. Satisfactory cutting performance cannot be expected, however, because the rotation of the other circular blade tends to be unstable. In this conventional cutting mechanism, the circular blades engage each other in overlapping manner so that they overlap the paper during cutting operation. With this arrangement, the other circular blade contacts the remaining portion of the paper during cutting operation, posing problem that the circular blade might scratch the paper. This causes the paper to flutter, inducing occurrence of "jamming".

Thus, it is difficult to apply the conventional sheet cutting mechanism that uses the circular blade in cooperation with another circular blade or auxiliary blade to apparatuses, for example, facsimile, printer or the like, that use thermograph paper. These apparatuses have used the cutting mechanism that uses the circular blade in cooperation with the stationary blade or the cutting mechanism of the so-called guillotine type. One representative example of the guillotine type cutting mechanism is disclosed in JP-B 50-24466.

An object of the present invention is to provide a high performance inexpensive sheet cutting mechanism that has combined the merits of the conventional cutting mechanism that uses the circular blade with the stationary blade with the merits of the conventional cutting mechanism that uses the two circular blades.

SUMMARY OF THE INVENTION

The present invention has been made after study of various kinds of measures with an intention to find the best solution to accomplish the above-mentioned task.

According to the present invention, there is provided a mechanism for cutting a sheet, comprising of:

a frame having a stand portion that has on one side a flat surface adapted to support a sheet to be cut, a blade stand supported by said frame for a forward movement and the subsequent reverse movement along said stand portion;

a circular rotary blade supported by said blade stand for rotation about a rotary blade axis;

a circular counter blade supported by said blade stand for rotation about a counter blade axis, said counter blade having an outer periphery substantially flush with said flat surface on said stand portion;

said rotary blade engaging said counter blade at a contact point, said counter blade axis being disposed forwardly of said rotary blade axis with respect to the forward movement of the blade stand, and means for providing an arrangement in which, the forward movement of said blade stand causes said rotary blade to rotate and said counter blade to rotate.

BRIEF DESCRIPTION OF THE DRAWINGS

FIG. 12(*b*) shows, in arrows, load, which the sheet of paper is subject to upon making an initial cut by the known sheet cutting mechanism using a circular blade and an auxiliary blade;

FIG. 12(*c*) shows, in arrow, load, which the sheet of paper is subject to upon making an initial cut by the known sheet cutting mechanism using two circular blades;

FIG. 13(*b*) shows an opening angle of the known sheet cutting mechanism using the circular blade and the stationary blade;

FIG. 13(*c*) shows an opening angle of the known sheet cutting mechanism using two circular blades;

DETAILED DESCRIPTION OF THE INVENTION

Referring to FIGS. 1 through 11 and FIG. 13(*a*), the present invention is further described along with preferred embodiments thereof.

Figure 1:
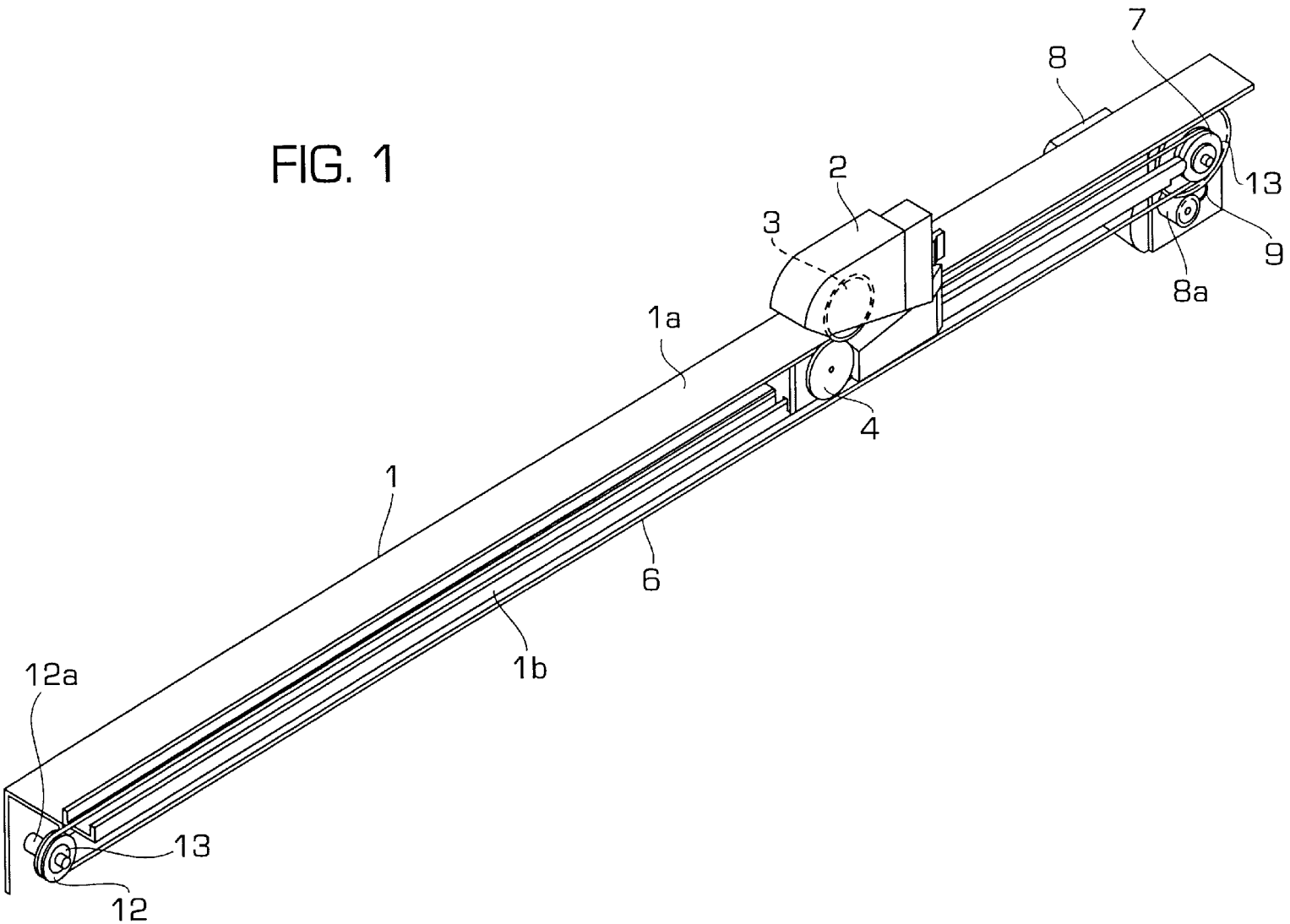
FIG. 1 is a perspective view of a sheet cutting mechanism according to the present invention.

As shown in FIGS. 1, 2(*a*), 2(*b*), 2(*c*) and 3, the sheet cutting mechanism according to the present invention is comprised of an elongate cutter frame 1. The cutter frame 1 is formed with a flat elongate stand portion 1*a* and includes a rail portion 1*b*. The cutter frame 1 has mounted thereto a blade stand 2. The blade stand 2 is movable with respect to the cutter frame 1. The blade stand 2 has a rotary or circular blade 3 and a counter blade 4 in the form of a disc. Both of the circular and counter blades 3 and 4 are supported by the blade stand 2 for rotation about their axes, respectively. The blade stand 2 may be manually moved along the rail 1*b*. In this embodiment, however, a conveyer in the form of a driver utilizing a wire 6 moves the blade stand 2. Alternatively, an appropriate driver of the other type may be used.

The stand portion 1*a* and the rail portion 1*b* are formed integrally with the cutter frame 1 from a sheet of metal in order to reduce the number of component parts. In use of the sheet cutting mechanism as a part of a facsimile machine, the stand portion 1*a* may be used as a conveyer stand of the facsimile machine.

The rail portion 1*b* supports the blade stand 2 for its reciprocal motion between ends thereof. For ease of explanation, it is defined that, viewing in FIG. 2B, leftward movement of the blade stand 2 is forward movement and rightward movement thereof is backward movement. Likewise, a leftward direction viewing in FIG. 2B in which the blade stand 2 moves is a forward direction and a rightward direction is a rearward direction.

Figure 2A:
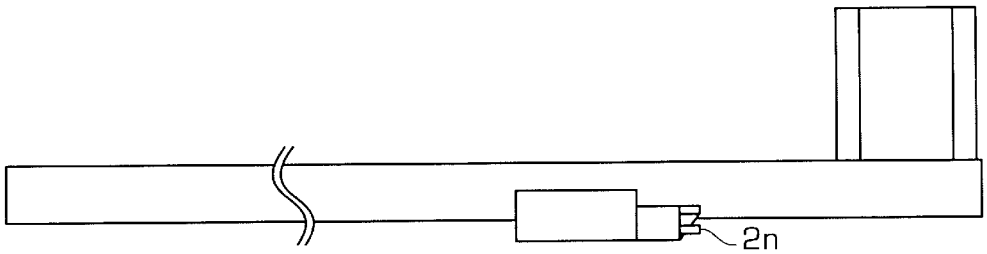
FIG. 2A is top plan view of the mechanism.
Figure 2B:
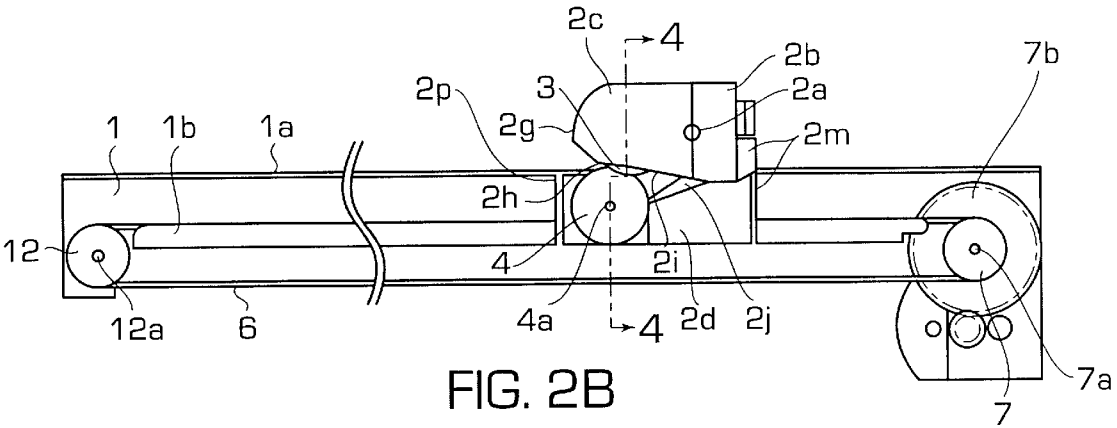
FIG. 2B is a front elevation of the mechanism.
Figure 2C:
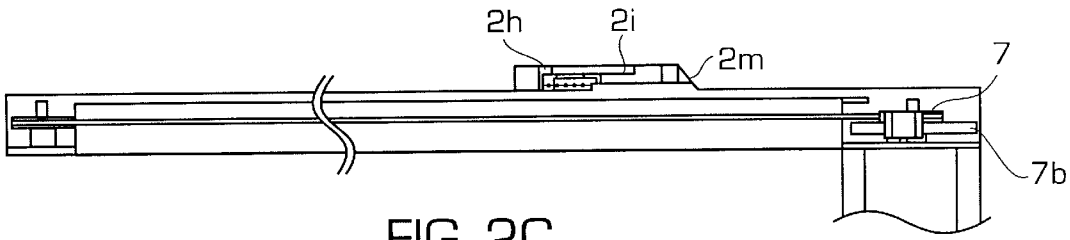
FIG. 2C is a bottom plan view of the mechanism.
Figure 2E:
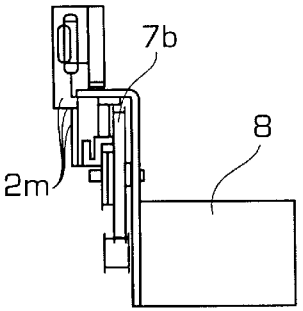
FIG. 2E is a right-hand view of the mechanism.
Figure 2D:
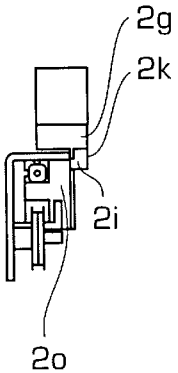
FIG. 2D is a left-hand view of the mechanism.

The blade stand 2 extends over the stand portion 1 and supports the blades 3 and 4. It is open in the forward direction to expose edges of the blades 3 and 4. The blade stand 2 includes an upper stand section 2*a* for the rotary blade 3 and a lower stand section 2*d* for the counter blade 4. The lower stand section 2*d* is formed with a recessed portion receiving the rail 1*b*. As shown in FIG. 2D, the upper and lower stand sections 2*a* and 2*d* are disposed above and below the stand portion 1*a* and bridged by an arm 2*k*. It is convenient that the upper stand section 2*a* is easy to remove. In this embodiment, the upper stand section 2*a* is composed of a support beam 2*b* and a rotary blade cartridge 2*c*. A lock 2*n* holds the rotary blade cartridge 2*c* to the support beam 2*b*. Without any tool, the rotary blade cartridge 2*c* is easy to remove.

Forward movement of the blade stand 2 performs cutting operation and is followed by the subsequent rearward movement to standby position ready for next cutting operation. As shown in FIGS. 2B, 2C and 2D, at its leading end portion, with respect to the forward direction, the upper stand section 2*a* has a first guide 2*g* and a second guide 2*h* connecting with the first guide 2*g*. The first guide 2*g* is in the form of a slope that is so inclined as to gather portion of paper that has been lifted due to the forward movement of the blade stand 2. The second guide 2*h* is in the form of a parallel surface to the stand portion 1*a*. This surface 2*h* is opposed to the stand portion 1*a* and the peripheral edge of the counter blade 4, cooperating with them to define a narrow clearance. The narrow clearance guides the paper toward the cutting point at which the rotary blade 3 and the counter blade 4 contact each other. The surface of the second guide 2*h* connects with a third guide 2*i* that is arranged to urge the paper having been cut in a predetermined direction. The third guide 2*i* is a gradually angled slope extending into the arm 2*k* (see FIGS. 2B, 2C and 2D). The angle of this slope 2*i* should be less steep because, if this slope is angled steeply, the arm 2 interferes with the paper. These first, second and third guides 2*g*, 2*h* and 2*i* cooperate with each other to provide an arrangement which suppresses undesired movement of the paper prior to cutting and urges the paper after cutting to escape in the predetermined direction. Thus, smooth cutting operation is provided without a paper-conveying guide that is spaced from the edge of a stand portion. Besides, the third guide 2*i* prevents the paper having been cut from contacting with the arm 2*k*, thus avoiding occurrence of jamming induced due to interference with the arm 2*k*. After having been cut, the paper tends to drop on the remote side of the lower stand section 2*d* from the stand portion 1*a*. If the paper drops on a portion adjacent the lower stand section 2*d*, there is the possibility that it may be engaged by the counter blade 4 during the subsequent rearward return movement of the blade stand 2 or the next forward movement thereof. Thus, the lower stand section 2*d* is formed with a fourth or push-out guide 2*j* for keeping the paper away from the counter blade 4. The fourth guide 2*j* is in the form of a slope extending downwardly in a direction away from the rotary blade 3 and the counter blade 4. There is the possibility that the paper pieces may come into contact with the blade stand during its forward and rearward movement. If the blade stand 2 kicks the paper piece, there occurs jamming. Thus, it is necessary to provide means for preventing the blade stand 2 from kicking the paper piece. Thus, the blade stand 2 is formed, at its front end, with a front plow 2*p* and, at its rear end, with a rear plow 2*m* (see FIGS. 2B, 2C and 2E). The front plow 2*p* is in the form of a surface so inclined as to push the paper piece away from the blade stand 2 as the blade stand 2 moves in the forward direction. The rear plow 2*m* is in the form of surface portions so inclined as to push the paper piece away from the blade stand 2 as the blade stand 2 moves in the rearward direction.

It is readily seen from FIG. 1 that the sheet of paper is easy to set on the stand portion 1*a* because all the necessary components for moving the blade stand 2 are arranged below the stand portion 1*a* and there is nothing on or over the stand portion 1*a*.

Figure 3:
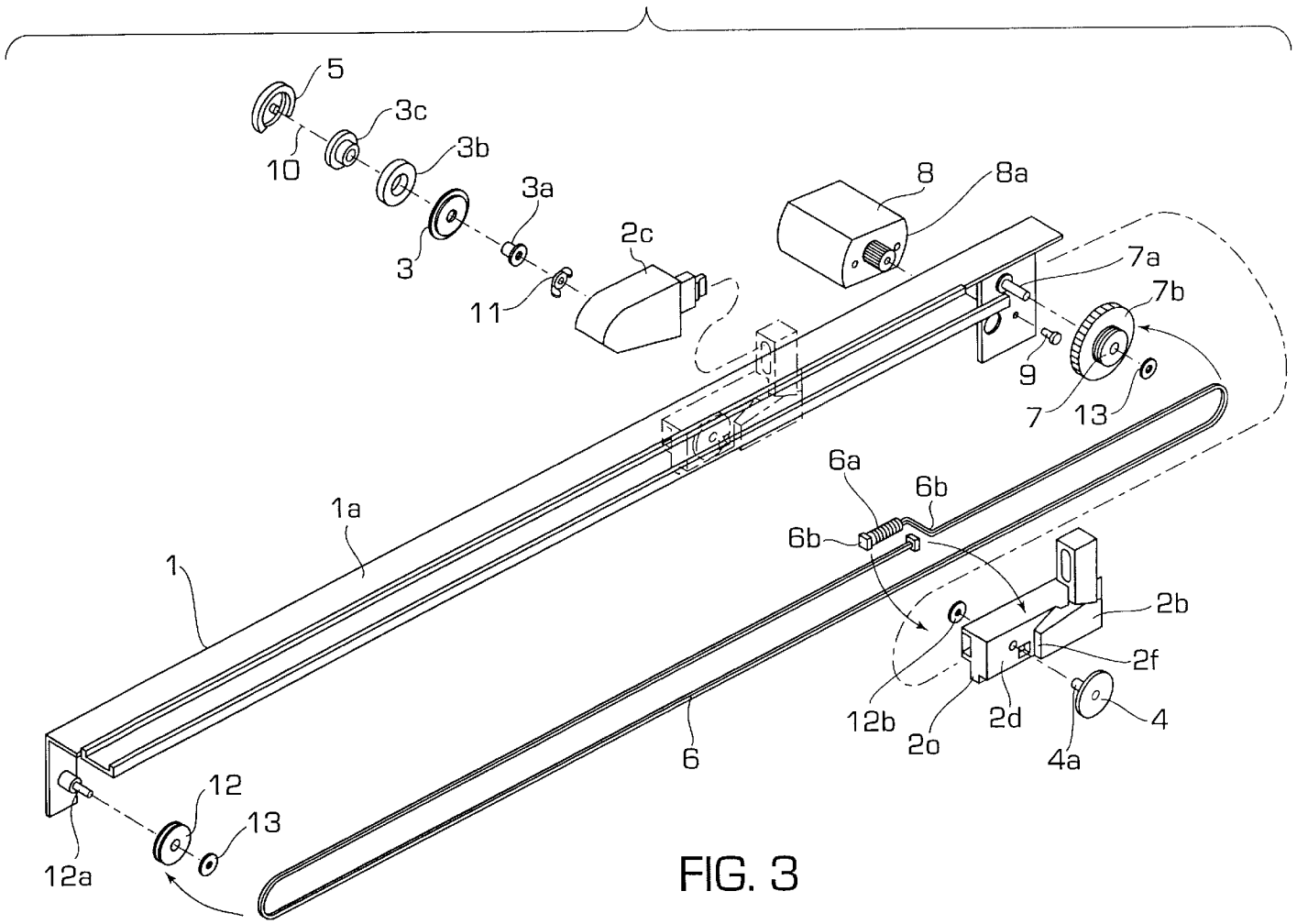
FIG. 3 is a perspective exploded view of the mechanism.

As mentioned before, the driver employing the wire 6 functions to convey or move the blade stand 2. As best seen in FIG. 3, the wire 6 has, at its one and opposite ends, fixtures 6*b*. A coil spring 6*a* is wound around the wire 6 at a portion adjacent the one end thereof. At one end thereof, the coil spring 6*a* abuts the fixture 6*b* to which the one end of the wire 6 is attached. The coil spring 6*a* is provided to apply tension to the wire 6. With the fixtures 6*b*, the one and the opposite ends of the wire 6 are anchored to the lower stand section 2*d* of the blade stand 2. As viewed in FIG. 2B, the cutter frame 1 has, at a right-hand end portion, a driver pulley shaft 7*a* and, at a left-hand end portion, an intermediate pulley shaft 12*a*. The driver pulley shaft 7*a* supports a driver pulley 7 and the intermediate pulley shaft 12*a* an intermediate pulley 12. The driver pulley 7 is formed integrally with a driver gear 7*b* (see FIGS. 2B, 2C, 2E and 3) for unitary rotation therewith. A motor 8 with a pinion 8*a* on its rotary output shaft is fixedly attached to the cutter frame 1 by screw means 9. The pinion 8*a* meshes the driver gear 7*b* for transmitting rotation of the motor 8 to the driver pulley 7. Snap rings 13 are attached to the shafts 7*a* and 12*a* to hold the driver and intermediate pulleys 7 and 12 on the shafts 7*a* and 12*a*, respectively.

Figure 4:
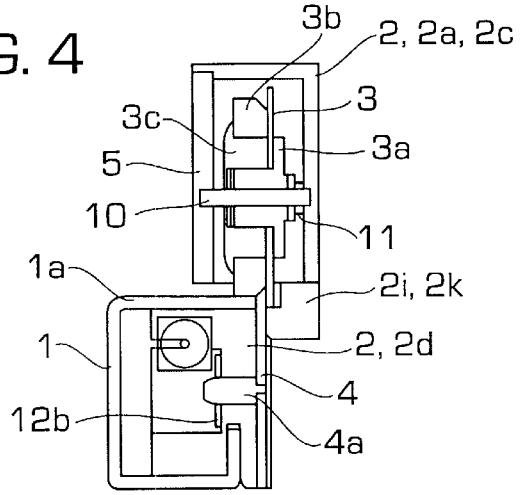
FIG. 4 is a section taken through the line 4—4 of FIG. 2B.

Referring to FIGS. 3 and 4, a bearing 3*a*, a wheel 3*b* and a flange 3*c* are assembled with the rotary blade 3 for rotation, as a unit, about a rotary blade shaft 10 within the rotary blade cartridge 2*c*. As best seen in FIG. 4, the shaft 10 has one end supported by an end plate of the cartridge 2*c* and the opposite end supported by a lid 5 that is opposed to and spaced from the end plate. The rotary blade 3 has at its outer periphery a sharpened edge. A plate spring 11 supported by the shaft 10 biases the rotary blade 3 against the counter blade 4 at its edge portion. The wheel 3*b* surrounds the flange 3*c*. The flange 3*c* fixedly carries the wheel for rotation therewith. The shaft 10 is distant from the surface of the stand portion 1*a* less than a radius of the wheel under unstressed state such that the wheel 3*b* is pressed against the stand portion 1*a*. This causes the wheel 3*b* to resiliently deform by a predetermined amount. Thus, movement of the blade stand 2 causes the wheel 3*b* to rotate, causing the rotary blade 3 to rotate accordingly. The wheel 3*b* and the lower stand section 2*d* interpose between them the stand portion 1*a* due to reaction of the deformation of the wheel 3*b*. The lower stand section 2*d* carries the counter blade 4.

The counter blade 4 has a shaft 4*a* fixedly connected thereto. A bearing 2*f* of the lower stand section 2*d* supports the shaft 4*a* of the counter blade 4 for rotation. A snap ring 12*b* prevents removal of the shaft 4*a* from the bearing 2*f*. Due to the bias of the plate spring 11, the rotary blade 3 urges the counter blade 4 against the side edge of the stand portion 1*a*. In other words, at a portion near its outer periphery on one side, the counter blade 4 frictionally engages the side edge of the blade stand 1*a* and, at a portion near its outer periphery on the opposite side thereof, it frictionally engages the rotary blade 3. This arrangement provides, during movement of the blade stand 2, application of moment from the side edge of the stand portion 1*a* to one side of the counter blade 4 and application of moment from the rotary blade 3 to the opposite side of the counter blade 4. This ensures stable rotation of the counter blade 4 without any wheel.

Figure 5A:
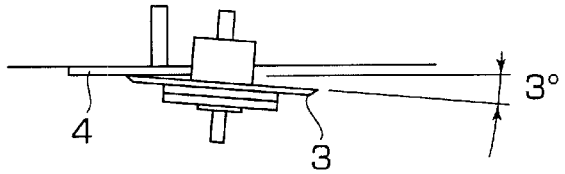
FIG. 5A is a fragmentary top view of the mechanism showing a circular blade and a counter blade.
Figure 5C:
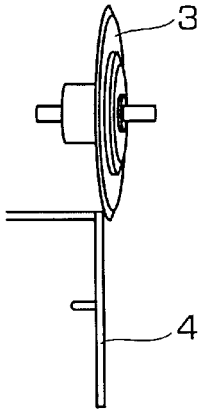
FIG. 5C is a left-hand side view of the circular blade and the counter blade as viewed from the front with respect to the forward direction of movement of the front and counter blade for cutting the sheet of paper.
Figure 5B:
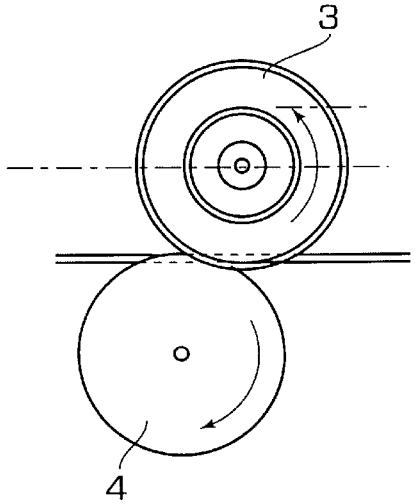
FIG. 5B is a front elevation of the circular blade and the counter blade in relation to the level of a stand.

Referring to FIGS. 5A, 5B and 5C, the arrangement of the rotary blade 3 and counter blade 4 is further explained As best seen in FIGS. 5A and 5B, the counter blade 4 is disposed forwardly, with respect to the forward direction, of the rotary blade 3. In other words, the axis of the counter blade 4 is disposed forwardly of the axis of rotary blade 3. The contact point between the rotary blade 3 and counter blade 4 is generally as high as the top surface of the stand portion 1*a*. The edge of the counter blade 4 is generally as high as the top surface of the stand portion 1*a*. The rotary blade 3 overlaps the counter blade 4 by an amount exceeding a predetermined value. The rotary blade 3 is pressed against the counter blade 4 by the plate spring 11, thus pressing the counter blade 4 against the side edge of the stand portion 1*a*.

Figure 12A:
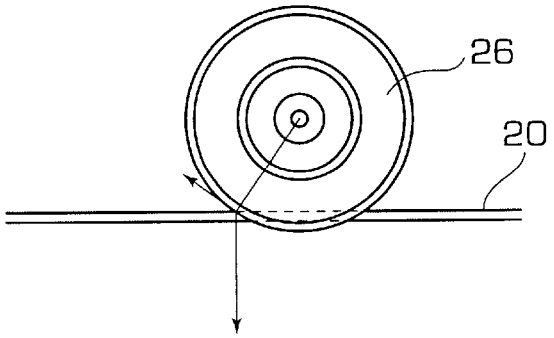
FIG. 12(a) PRIOR ART
FIG. 12(*a*) shows, in arrows, load, which the sheet of paper is subject to upon making an initial cut by the known sheet cutting mechanism using a circular blade and a stationary blade.
Figure 12B:
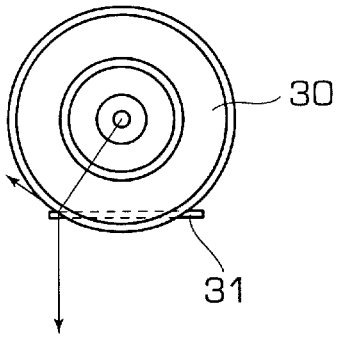
FIG. 12(b) PRIOR ART
Figure 12C:
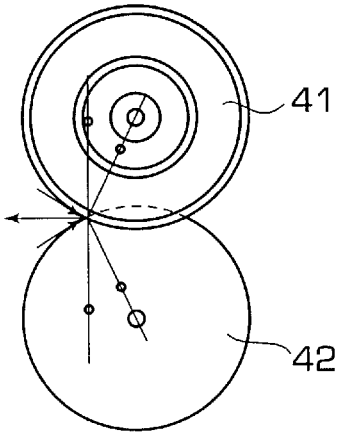
FIG. 12(c) PRIOR ART
Figure 13A:
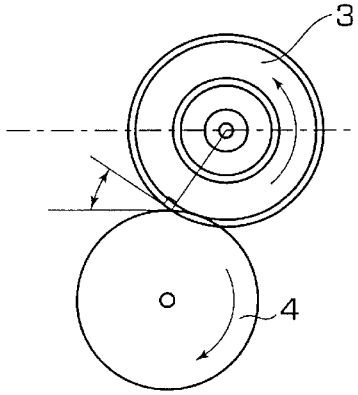
FIG. 13(*a*) shows an opening angle of the sheet cutting mechanism according to the present invention.
Figure 13B:
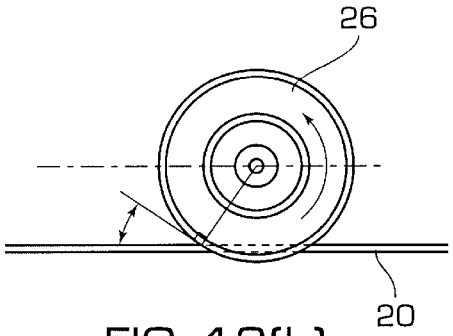
FIG. 13(b) PRIOR ART
Figure 13C:
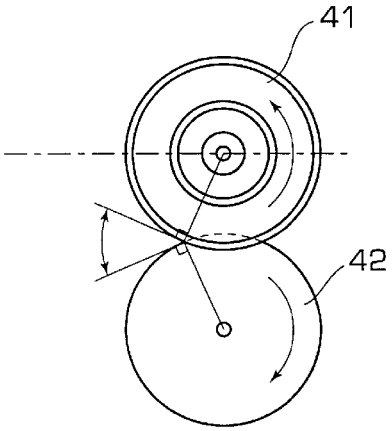
FIG. 13(c) PRIOR ART
Figure 14:
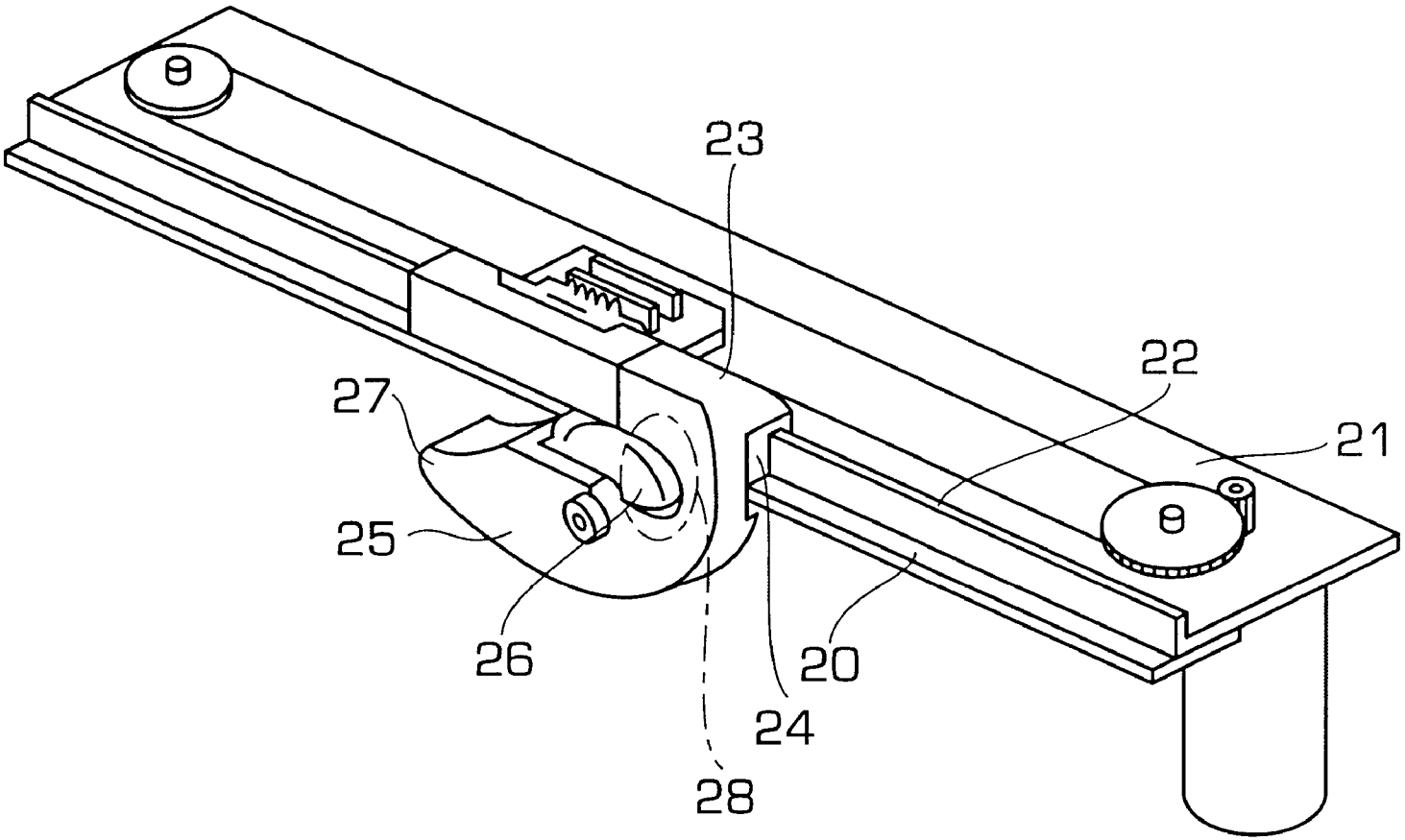
FIG. 14 PRIOR ART
FIG. 14 is a perspective view of the known sheet cutting mechanism using the circular blade and the stationary blade.
Figure 15:
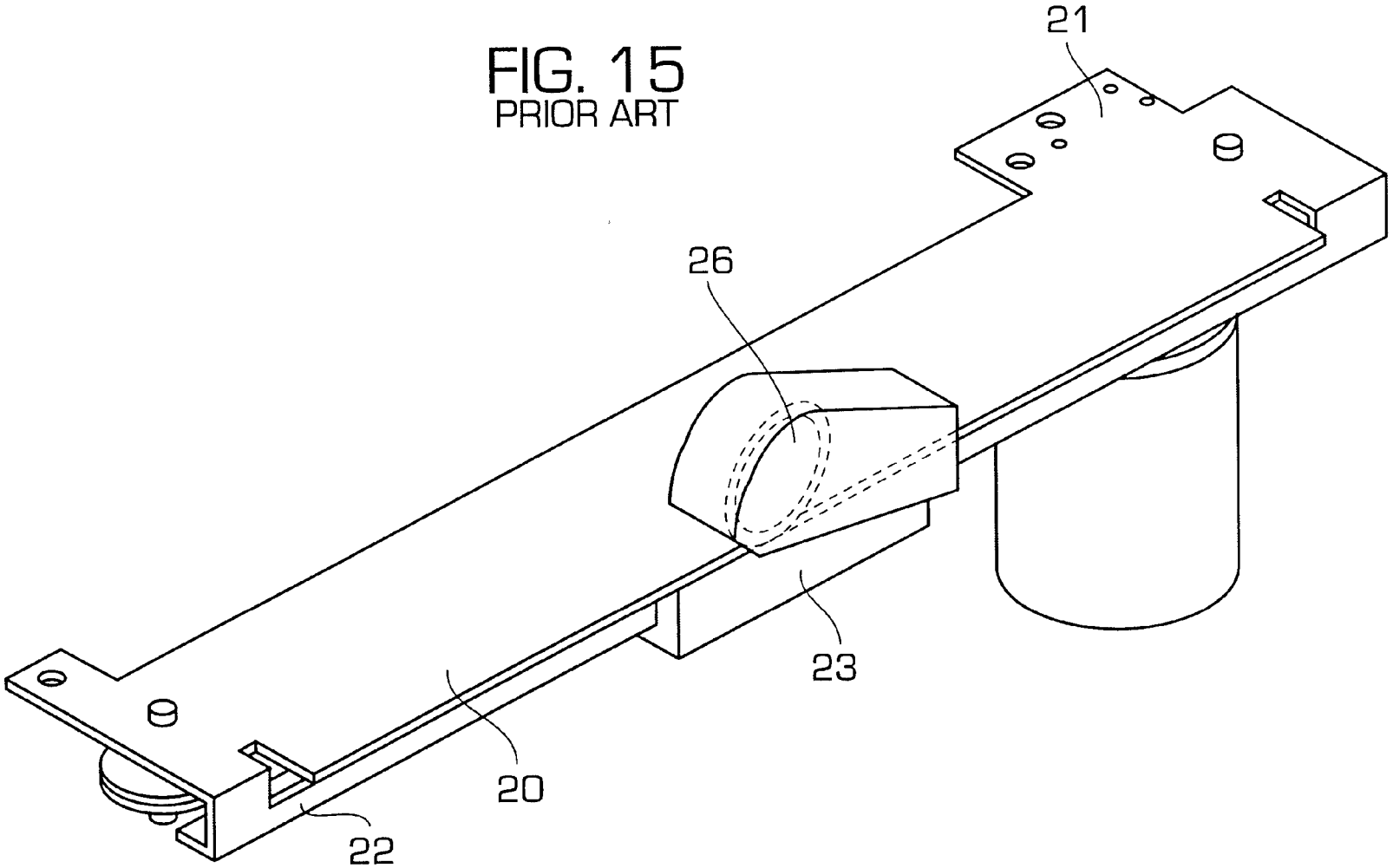
FIG. 15 PRIOR ART
FIG. 15 is a perspective view of the known improved version of sheet cutting mechanism using the circular blade and the stationary blade.
Figure 16:
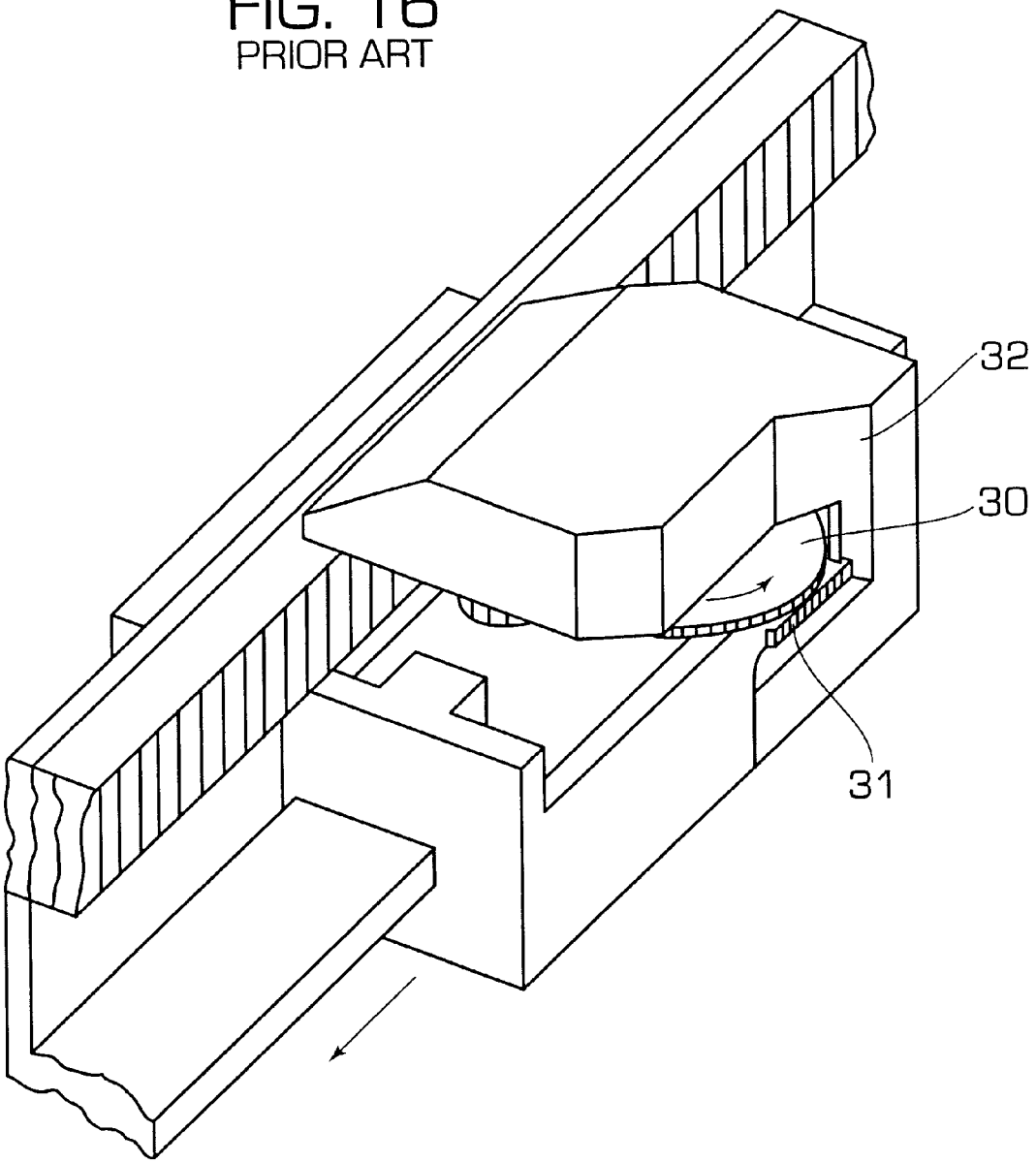
FIG. 16 PRIOR ART
FIG. 16 is a fragmentary perspective view of the known sheet cutting mechanism using the circular blade and the auxiliary blade.
Figure 17:
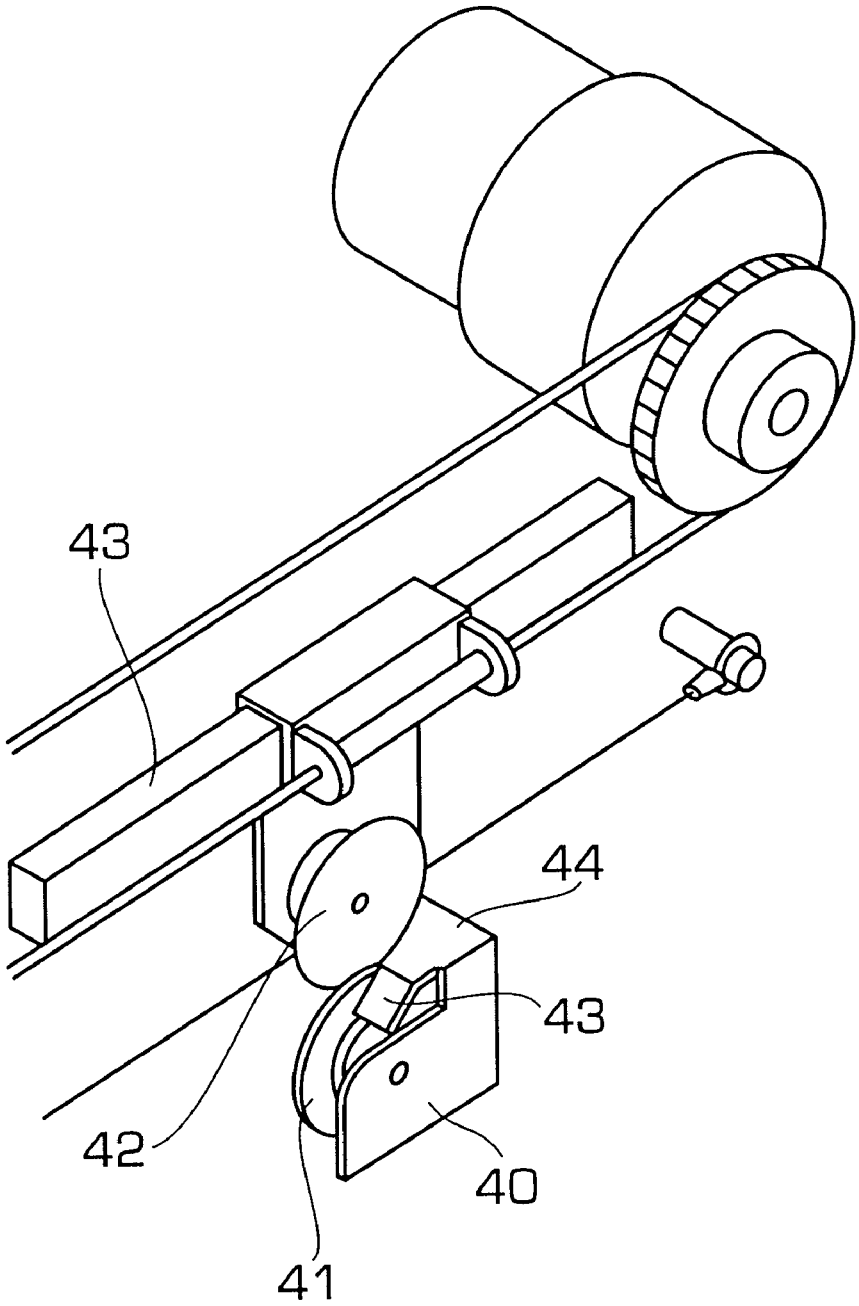
FIG. 17 PRIOR ART
FIG. 17 is a fragmentary perspective view of the known sheet cutting mechanism using the two circular blades.

Moving the blade stand 2 to the left viewing in FIG. 5B causes the wheel 3*b* to rotate counterclockwise, causing the rotary blade 3 to rotate accordingly. Counterclockwise rotation of the rotary blade 3 and leftward movement of the blade stand 2 relative to the stand portion 1*a* cooperate with each other to impart torque to the counter blade 4, causing the counter blade 4 to rotate clockwise viewing in FIG. 5B. Referring to FIGS. 13(*a*) and 13(*b*), an opening angle defined between the rotary blade 3 and the counter blade is substantially the same as an opening degree defined between the circular blade 26 and the stationary blade 20. Therefore, there occurs no divergence of load inherent with cutting operation, which has occurred in the known cutting mechanism using two circular blades as illustrated in FIG. 12(*c*). Besides, since the counter blade 4 is driven to rotate, the load is converted into a force with which the counter blade 4 drives the paper toward the cutting point. Thus, in the sheet cutting mechanism according to the present invention, the paper is not subject to any force tending to press the paper, making it easy to cut the paper. In order to accomplish this effect, the counter blade 4 must rotate uninterruptedly and continuously. In the embodiment according to the present invention, the counter blade 4 is driven to rotate uninterruptedly and continuously without any wheel as mentioned before.

Viewing in FIG. 5B, the periphery of the edge of the rotary blade 3 and that of the counter blade 4 intersect with each other at two points. At the forward one of the two intersection points, the rotary blade 3 contacts with the counter blade 4 at a single point. To accomplish this arrangement, the rotary blade 3 is disposed in a plane that intersects a cutting surface plane and forms a predetermined angle with the cutting surface plane as shown in FIG. 5A. The predetermined angle ranges from 0.5 degrees to 5 degrees. In this embodiment, the predetermined angle is approximately 3 degrees. The amount by which the rotary blade 3 overlaps the counter blade 4 is not less than 0.3 mm. Preferably, this overlapping amount is not less than 0.7 mm. In this embodiment, the diameter of the rotary blade is 14.5 mm, and the diameter of the counter blade 4 is 13 mm. The setting is such that the overlapping amount between the rotary blade 3 and the counter blade 4 remains even if the rotary blade 3 is lifted due to load caused by jamming. For increased cutting performance, the counter blade with increased diameter is advantageous. However, the counter blade 4 of this dimension proves to show satisfactory high cutting performance. With the arrangement according to the present invention, it has been confirmed by experiments that satisfactory cutting performance is accomplished with the counter blade 4 with its edge rounded as far as roundness of the edge falls in a predetermined range. Thus, it is not necessary to sharpen the edge of the counter blade 4. According to the experiments, it has been confirmed that, with the edge of the counter blade 4 less than R0.2, satisfactory cutting performance results. According to the experiments, it has been confirmed that the sheet cutting mechanism according to the present invention is applicable as an automatic cutter for cutting tissue for home use. The edge of the counter blade 4 must have the same roundness throughout the whole length in peripheral direction. This can be accomplished by using as the counter blade 4 a disc produced by press-machining a sheet of steel. As the material of the counter blade 4, steel classified as general-purpose steel in Japanese Industrial Standard (JIS) may be used as the material of the counter blade 4.

Figure 6:
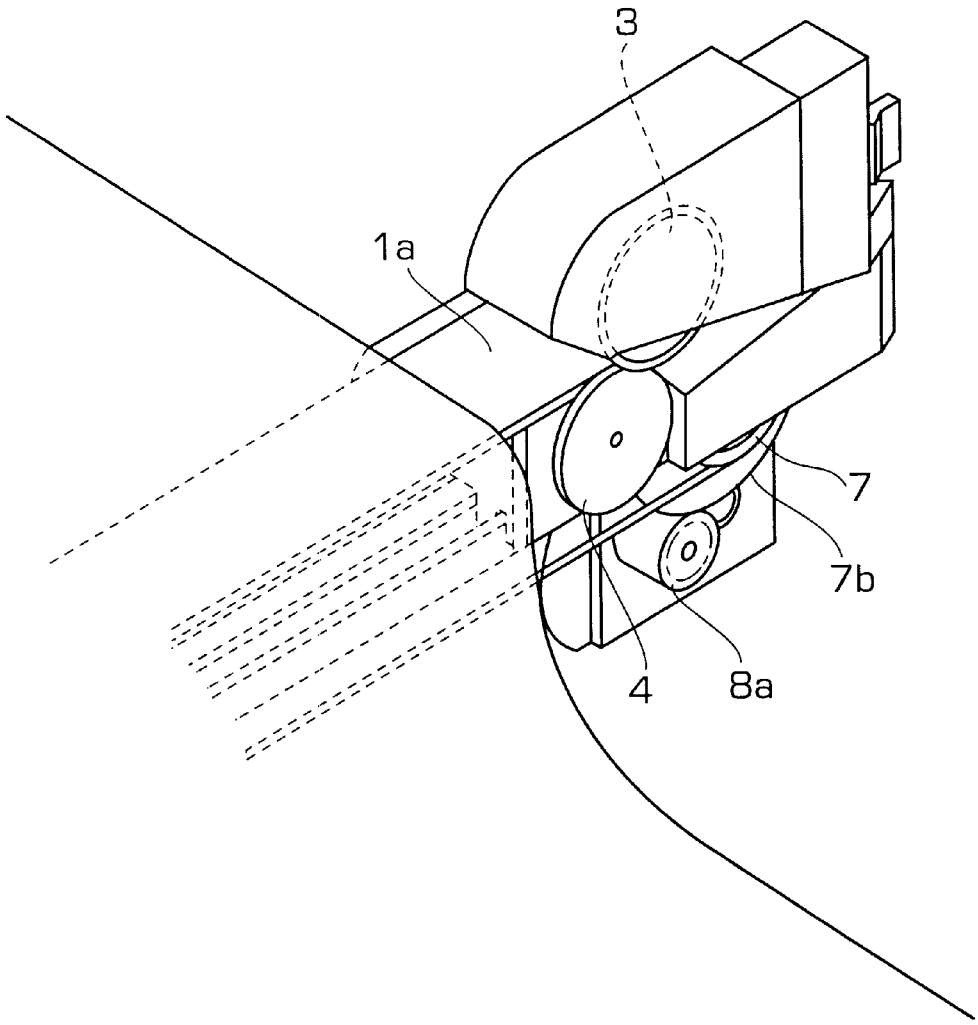
FIG. 6 is a fragmentary perspective view of the mechanism with a blade stand in its home or standby position.
Figure 7:
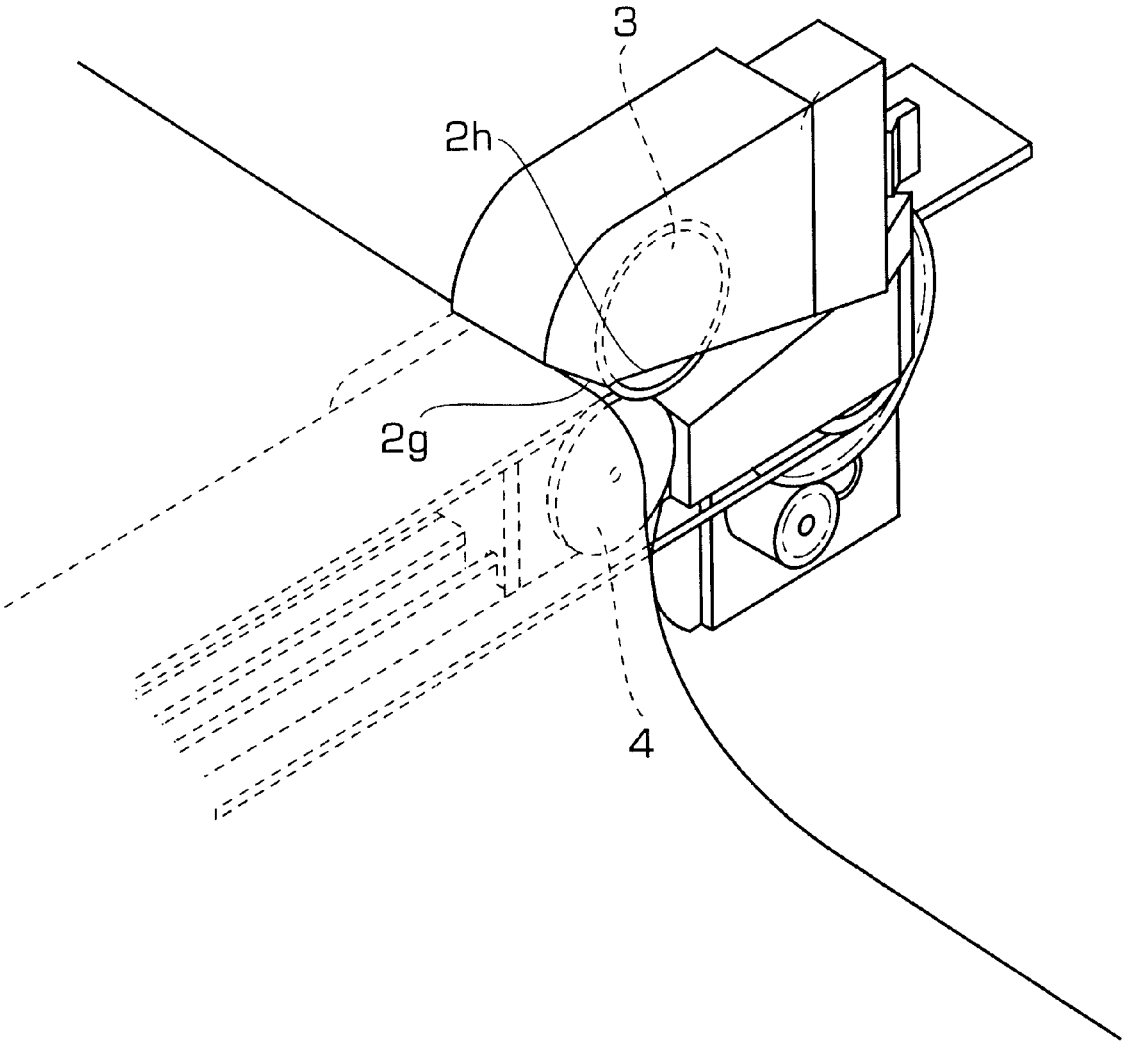
FIG. 7 is a similar view to FIG. 6 with the circular blade and the counter blade about to cut in the sheet of paper.
Figure 8:
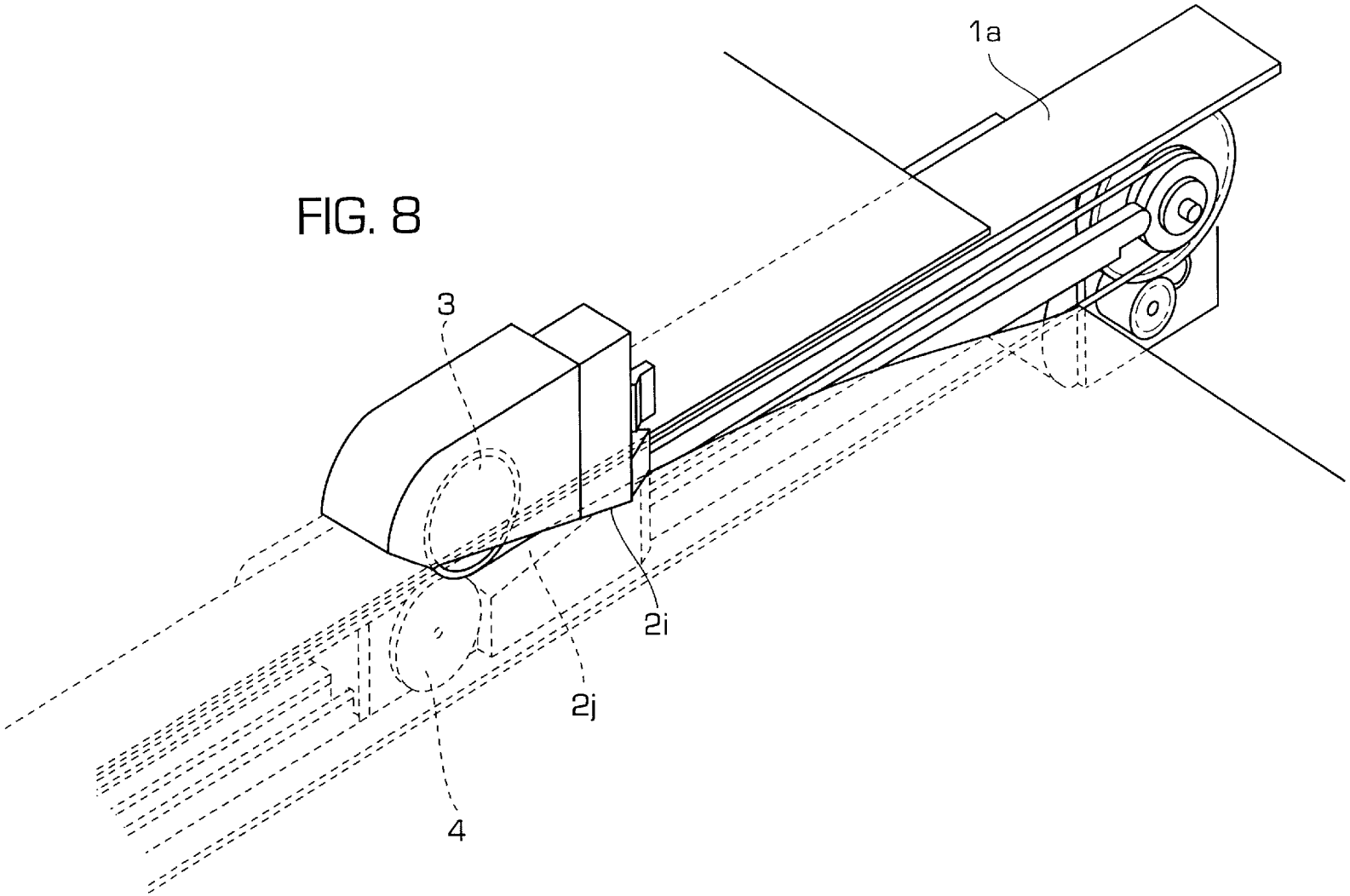
FIG. 8 is a similar view to FIG. 7 with the circular blade and the counter blade in the process of cutting the sheet of paper.
Figure 9:
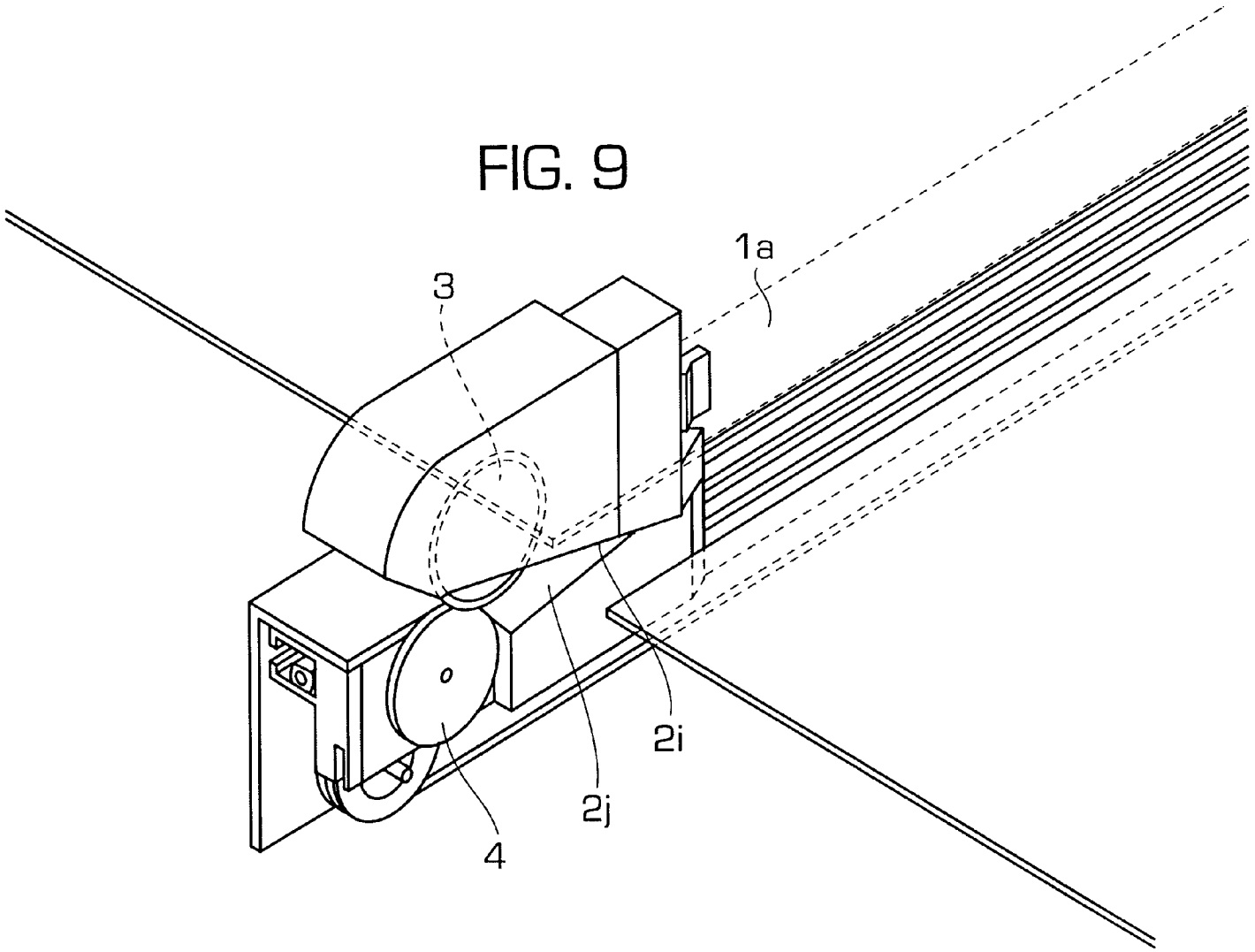
FIG. 9 is a similar view to FIG. 8 with the circular blade and the counter blade just ended cutting operation.

Referring to FIGS. 6 to 9, the operation of the sheet cutting mechanism according to the present invention is described. FIG. 6 shows the blade stand 2 in its standby position. The blade stand 2 assumes the standby position when it abuts the driver pulley 7. Rotation of the motor 8 is transmitted from the pinion 8*a* to the driver gear 7*b* and the driver pulley 7, causing the driver pulley 7 to rotate. Rotation of the driver pulley 7 causes the wire 6 to move the blade stand 2 in the forward direction. In response to this movement of the blade stand 2, the rotary blade 3 and the counter blade 4 rotate. At the cutting point, the edge of the rotary blade 3 and that of the counter blade 4 move in the opposite direction to the forward direction of movement of the blade stand 2. Immediately after the blade stand 2 has moved in the forward direction from the standby position shown in FIG. 6, the counter blade 4 moves under the reverse or hidden side of the paper. If the paper rolls toward the reverse side as shown in FIG. 7, the counter blade 4 lifts the paper up and guides it toward the cutting point because the edge of the counter blade 4 moves in the opposite direction to the forward direction of the blade stand 2. At the cutting point, the counter blade 4 holds the paper flat. If the paper rolls toward the reverse side, the counter blade 4 guides the paper toward the cutting point, and if the paper rolls toward the front side, the first guide 2*g* guides the paper toward the cutting point. The fact that the paper rolls does not pose any problem. When the cutting operation is in progress as shown in FIG. 8, the third guide 2*i* guide the piece of paper having been cut downward. Since the slope of the third guide 2*i* is gradual, the piece of paper having been cut is smoothly guided. At the same time, the fourth guide 2*j* pushes the piece of paper having been cut away from the counter blade 4. Thus, the piece of paper having been cut drops at an area slightly spaced from the sheet cutting mechanism as shown in FIG. 9. After completion of cutting operation, the blade stand 2 abuts the intermediate pulley 12 and comes to a stop. A timer controls rotation of the motor 8. The motor 8 rotates clockwise for a predetermined period of time and then rotates counterclockwise for the subsequent predetermined period of time. In the present embodiment, for cutting a sheet of paper having a width of 257 mm, the motor rotates clockwise for 1 second and then counterclockwise for the subsequent 1 second. When the blade stand 2 returns to the standby position and the motor 8 ceases to rotate, the cutting operation is completed. The manner of controlling the motor 8 is described in JP-B 7-39580 U. The manner of controlling the motor 8 is not limited to this example. Any desired means for or method of controlling the motor 8 may be used.

Touching on the safety of the sheet cutting mechanism, the rotary blade 3 is stored in the blade stand 2 and its exposure is reduced to the required minimum. Thus, the blade stand 2 prevents the operator from unintentionally touching the edge of the rotary blade 3. The counter blade 4 is not completely stored in the blade stand 2. However, the edge of the counter blade is rounded so that there is no danger that the counter blade 4 cuts the operator's fingers.

Figure 10:
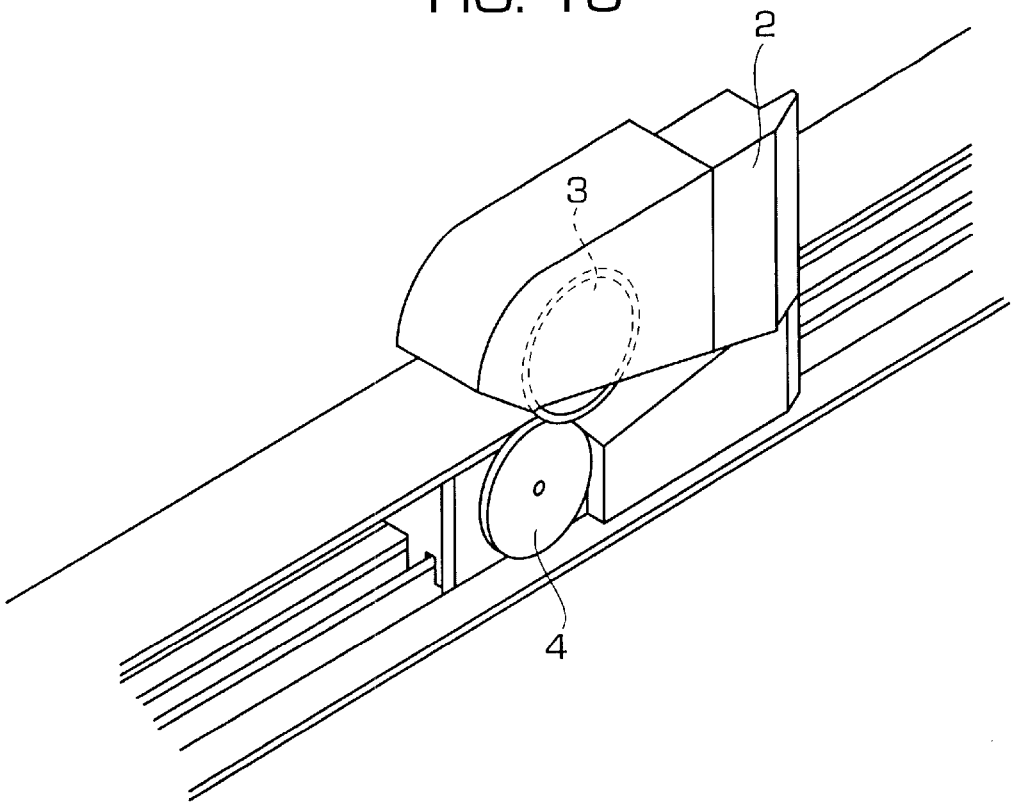
FIG. 10 is a fragmentary perspective view of another embodiment according the present invention.
Figure 11:
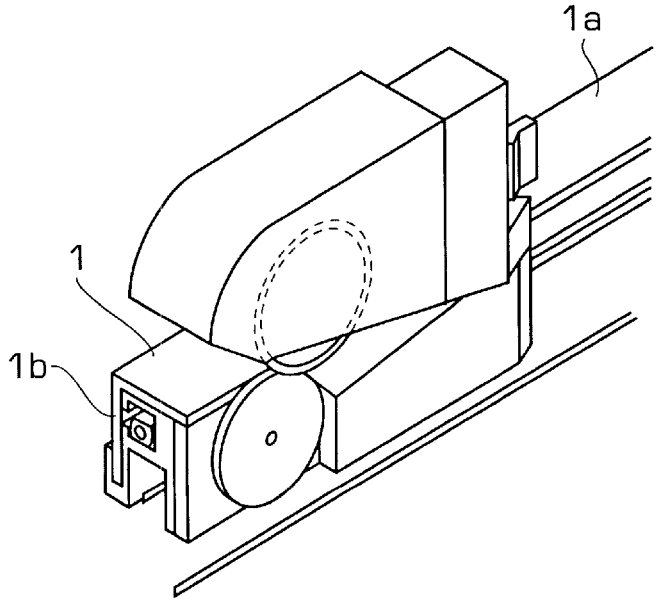
FIG. 11 is a fragmentary perspective, partly sectioned, view of still another embodiment.

In the previously described embodiment, the upper stand section 2*a* for the rotary blade 3 is easy to separate from the rest of the blade stand 2 due to the provision of the cartridge 2*c*. Alternatively, a blade stand 2 of the inseparable type as shown in FIG. 10 may be used. FIG. 11 shows a capital L type cutter frame 1, which may be used instead of the cutter frame. Although, not illustrated, a cutter frame made of synthetic resin may be used instead of the cutter frame formed from a sheet of metal.

What is claimed is:

1. A mechanism for cutting a sheet, comprising:

a frame having a stand portion that has on one side a flat surface adapted to support a sheet to be cut;

a blade stand supported by said frame for a forward movement and a subsequent reverse movement along said stand portion;

a circular rotary blade supported by said blade stand for rotation about a rotary blade axis, said rotary blade axis located above a plane defined by said flat surface of said stand portion;

a circular counter blade supported by said blade stand for rotation about a counter blade axis, said counter blade axis located below the plane defined by said flat surface of said stand portion;

said rotary blade engaging said counter blade at a contact point, said counter blade axis being disposed forwardly of said rotary blade axis with respect to the forward movement of the blade stand, and means for rotating said rotary blade and said counter blade in response to the forward movement of said blade stand along said stand portion.

2. The mechanism as claimed in claim 1, wherein said means include a spring biasing said rotary blade into engagement with said counter blade at said contact point.

3. A mechanism for cutting a sheet, comprising:

a frame having a stand portion that has on one side a flat surface adapted to support a sheet to be cut;

a blade stand supported by said frame for a forward movement and a subsequent reverse movement along said stand portion;

a circular rotary blade supported by said blade stand for rotation about a rotary blade axis, said rotary blade axis located above a plane defined by said flat surface of said stand portion;

a circular counter blade supported by said blade stand for rotation about a counter blade axis, said counter blade axis located below the plane defined by said flat surface of said stand portion;

said rotary blade engaging said counter blade at a contact point, said counter blade axis being disposed forwardly of said rotary blade axis with respect to the forward movement of the blade stand, and means for rotating said rotary blade and said counter blade in response to the forward movement of said blade stand along said stand portion; and wherein said means include a side edge of said stand portion, which cooperates with said rotary blade to interpose said counter blade between said side edge and said rotary blade, and a spring biasing said rotary blade into frictional engagement with said counter blade at said contact point to urge said counter blade into frictional engagement with said side edge.

4. The mechanism as claimed in claim 3, wherein, viewing along said counter blade axis, said rotary blade overlaps said counter blade so that a periphery thereof intersects a periphery of said counter blade at a first intersection point and a second intersection point disposed forwardly of said first intersection point with respect to the forward movement of said blade stand, and wherein said contact point coincides with said second intersection point.

5. The mechanism as claimed in claim 4, wherein said rotary blade is disposed within a plane that forms a predetermined angle with a plane including a cutting section of the sheet.

6. The mechanism as claimed in claim 5, wherein said predetermined angle ranges from 0.5 degrees to 5 degrees.

7. The mechanism as claimed in claim 5, wherein said predetermined angle is approximately 3 degrees.

8. The mechanism as claimed in claim 6, wherein said counter blade is in the form of a disc with edge rounded.

9. The mechanism as claimed in claim 8, wherein said disc results from press-machining a sheet of metal.

10. The mechanism as claimed in claim 9, wherein the material of said counter blade is steel classified as a general purpose steel according to Japanese Industrial Standard (JIS).

11. The mechanism as claimed in claim 3, wherein said means includes a wheel connected to said rotary blade for unitary rotation, said wheel cooperating with said blade stand to interpose said stand portion between said wheel and a portion of said blade stand.

12. The mechanism as claimed in claim 11, wherein, during forward movement of said blade stand, said counter blade is subject to a moment occurring at the frictional engagement with said rotary blade and to a moment occurring at the frictional engagement with said side edge.

13. The mechanism as claimed in claim 3, wherein said blade stand includes:

a first blade stand section, disposed above said flat surface on the one side of said stand portion, storing said rotary blade;

a second blade stand section, disposed below said flat surface, for storing said counter blade; and an arm interconnecting said first and second blade stand sections;

said first blade stand section having, at a front end thereof, a first guide, a second guide to which said first guide connects, and a third guide to which said second guide connects.

14. The mechanism as claimed in claim 13, wherein said second blade stand section has a slope inclined away from said rotary blade and said counter blade.

15. The mechanism as claimed in claim 14, wherein said second blade stand section has, at a front end thereof, a front plow portion, said front plow portion sloping away from said stand portion from the front end of said second blade stand section towards a rear end thereof.

16. The mechanism as claimed in claim 14, wherein said blade stand has, at a rear end thereof, a rear plow portion, said rear plow portion sloping away from said stand portion from the rear end of said second blade stand section towards a front end thereof.

17. A mechanism as claimed in claim 14, wherein said first blade stand section is separable and includes a cartridge.

18. The mechanism as claimed in claim 3, wherein said side edge of said stand portion is perpendicular to said flat surface.

19. The mechanism as claimed in claim 3, wherein said counter blade has an outer periphery substantially flush with said flat surface on said stand portion.

20. The mechanism as claimed in claim 11, wherein said wheel connected to said rotary blade rotates about an axis parallel to said rotary blade axis.

* * * * *

UNITED STATES PATENT AND TRADEMARK OFFICE

CERTIFICATE OF CORRECTION

PATENT NO. : 5,937,723
DATED : August 17, 1999
INVENTOR(S) : Takeharu KIRIKOSHI and Takahisa KINOSHITA It is certified that error appears in the above-identified patent and that said Letters Patent is hereby corrected as shown below:

Column 6, line 58, after "portion" insert --2o--.

Signed and Sealed this

Twentieth Day of June, 2000

*Attest:*

Q. TODD DICKINSON

*Attesting Officer*

*Director of Patents and Trademarks*